US006598622B1

(12) United States Patent
Reith et al.

(10) Patent No.: US 6,598,622 B1
(45) Date of Patent: Jul. 29, 2003

(54) DIRECTIONAL VALVE

(75) Inventors: Werner Reith, Eussenheim (DE); Binh Nguyen Xuan, Frammersbach (DE)

(73) Assignee: Bosch Rexroth AG, Lohr/Main (DE)

( * ) Notice: Subject to any disclaimer, the term of this patent is extended or adjusted under 35 U.S.C. 154(b) by 0 days.

(21) Appl. No.: 09/857,567

(22) PCT Filed: Nov. 3, 1999

(86) PCT No.: PCT/EP99/08383

§ 371 (c)(1),
(2), (4) Date: Jun. 4, 2001

(87) PCT Pub. No.: WO00/34667

PCT Pub. Date: Jun. 15, 2000

(30) Foreign Application Priority Data

Dec. 8, 1998 (DE) ..... 198 56 563

(51) Int. Cl.[7] ..... F15B 13/043

(52) U.S. Cl. ..... 137/625.66; 137/625.63; 137/625.64; 137/625.68

(58) Field of Search ..... 137/625.63, 625.64, 137/625.66, 625.68

(56) References Cited

U.S. PATENT DOCUMENTS

| | | | | | |
|---|---|---|---|---|---|
| 2,747,612 | A | * | 5/1956 | Lee | 251/282 |
| 3,009,480 | A | * | 11/1961 | Miller | 251/282 |
| 3,604,459 | A | | 9/1971 | Rosaen | |
| 4,155,535 | A | * | 5/1979 | Seamone | 251/282 |
| 4,220,178 | A | * | 9/1980 | Jackson | 251/282 |
| 4,646,786 | A | * | 3/1987 | Herder et al. | 251/282 |
| 4,923,172 | A | * | 5/1990 | Wood et al. | 251/282 |
| 4,938,118 | A | * | 7/1990 | Wolfges et al. | 137/625.64 |
| 5,445,188 | A | * | 8/1995 | Bourkel et al. | 137/625.64 |
| 5,520,217 | A | * | 5/1996 | Grawunde | 137/625.64 |
| 5,553,827 | A | * | 9/1996 | Perkey | 137/625.64 |
| 5,896,890 | A | * | 4/1999 | Bourkel et al. | 137/625.64 |
| 6,199,585 | B1 | * | 3/2001 | Reith et al. | 137/625.64 |

FOREIGN PATENT DOCUMENTS

| | | |
|---|---|---|
| DE | 249070 | 8/1987 |
| DE | 3734058 | 4/1988 |
| DE | 4111537 | 10/1992 |
| DE | 19710318 | 9/1998 |
| EP | 0628731 | 12/1994 |

OTHER PUBLICATIONS

Compensation of Steady–state Flow Forces in Spool–type Hydraulic Valves, Clark, p. 1784–1788 Transactions of the ASME, 11/57.

Discharge Coefficients and Steady–state Flow Forces for Hydraulic Poppet Valves, Stone, p. 144–154, Transactions of the ASME 3/60.

* cited by examiner

*Primary Examiner*—Gerald A. Michalsky
(74) *Attorney, Agent, or Firm*—Martin A. Farber

(57) ABSTRACT

A directional control valve which has a movable control piston (5) which separates two pressure chambers (6, 8) from each other in the valve housing interior, which pressure chambers can be subjected to control pressure in order to move the control piston (5) into axial positions corresponding to relevant switch positions of the valve in accordance with the difference in pressure prevailing between the control chambers (6, 8). An arrangement (29) acts on the control piston (5), produces an actuating force and prestresses the control piston for movement into an axial position corresponding to a desired predetermined position.

8 Claims, 1 Drawing Sheet

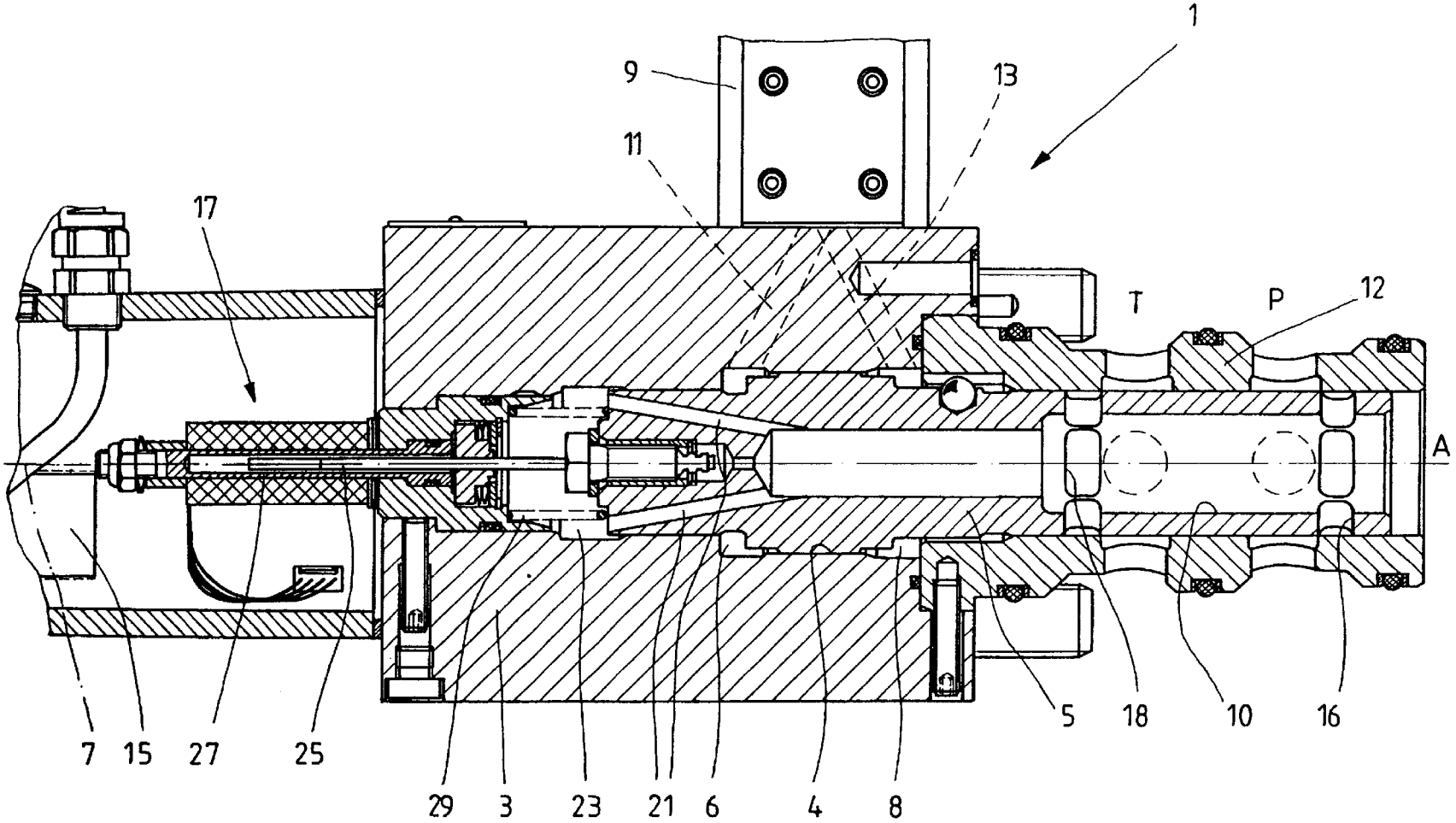
A
12
P
T
1
13
9
11
16
10
18
5
8
4
6
21
23
3
29
25
27
15
7
17

DIRECTIONAL VALVE

FIELD AND BACKGROUND OF THE INVENTION

The invention relates to a directional control valve which has a movable control piston which separates two pressure chambers from each other in the valve housing interior, which pressure chambers can be subjected to control pressure in order to move the control piston into axial positions corresponding to relevant switch positions of the valve in accordance with the difference in pressure prevailing between the control chambers.

Directional control valves of this type are known. For example, DE 197 10 318 A1 shows a valve of this type in the form of a three-way proportional fitted valve having an inductive travel sensor for detecting the position of the control piston and an added pilot valve via which the pressure chambers for controlling the position of the control piston can be subjected to control pressure in order to move the control piston into the relevant axial positions which correspond to the desired switch positions of the valve.

In the case of valves of this type, if, for some reason, no control pressure acts on the control piston, whether because the system which the valve forms part of is switched off and there is no system pressure, or whether a power failure at the pilot valve or emergency tripping causes the hydraulic short-circuiting of the pressure chambers at the control piston, then the pressure piston takes up an undefined, axial position. When the system pressure is switched on, a consumer which is connected may therefore execute an undesired, uncontrolled movement, which may constitute a risk of an accident or may result in a breakdown.

SUMMARY OF THE INVENTION

The invention is based on the object of providing a directional control valve in which the above-mentioned problems resulting because of a cessation of the control pressure are avoided.

In the case of a directional control valve of the type mentioned at the beginning, this object is achieved according to the invention by the fact that an arrangement is provided which acts on the control piston, produces an actuating force and prestresses said control piston for movement into an axial position corresponding to a desired predetermined position.

This ensures that even when there is no difference in pressure between the pressure chambers which can be subjected to the control pressure, the control piston takes up a position at which the system pressure can be switched on without any risk and without particular safety measures having to be taken.

When there is no difference in pressure in the pressure chambers, the desired position to be taken up by the control piston preferably corresponds to a position at which the valve forms a connection between a consumer connection and a tank connection. In this arrangement, if there is a cessation of the control pressure, a consumer which is connected comes into its final operating position, i.e. it moves to its end stop.

So that this process takes place without any risk, i.e. the consumer only moves slowly to its end stop, in a particularly advantageous exemplary embodiment the arrangement is made in such a manner that the arrangement producing the actuating force exerts a force on the control piston that counteracts flow forces which act on said control piston when pressure medium flows from the consumer connection to the tank connection, and that the size of the actuating force is selected to be just sufficient so that the flow forces, from a certain strength of the pressure-medium flow, compensate for the action of the actuating force on the control piston. The effect achieved by this is that when there is a lack of difference in the control pressure, the control piston is opened by the actuating force, which acts on it, with the effect of opening the connection from the consumer connection to the tank connection only to an extent sufficient for a certain strength of the pressure-medium flow to the tank connection to arise, at which strength the flow forces acting here on the control piston compensate for the actuating force. As a result, a state of equilibrium arises at a desired pressure-medium flow, which can be selected by the strength of the actuating force, from the consumer to the tank. With appropriate selection of the strength of the actuating force, which prestresses the control piston, this state of equilibrium corresponds to a strength of the pressure-medium flow at which the relevant consumer moves only very slowly to its end stop.

A spring arrangement can be provided to produce the actuating force acting on the control piston. In an advantageous exemplary embodiment in which the control piston forms, at its front end, a pipe valve which is guided in a valve bushing and whose open, front end is connected to the consumer connection and which has a control aperture which produces the connection to the tank connection in an axial position slid forward out of the valve housing, the spring arrangement is formed as a compression spring which is supported at one end on the tear end of the control piston and at the other end on the inner end of the valve housing interior. The spring force is selected in such a manner that even at a low strength of the flow of the pressure medium flowing into the open, front end of the pipe valve, the flow forces which are effective on the control piston equalize the spring force, so that the above-mentioned state of equilibrium arises even at a small pressure-medium flow.

BRIEF DESCRIPTION OF THE DRAWINGS

The invention is explained in detail below with reference to the drawing, in which the sole FIGURE shows a longitudinal section, drawn in a schematically simplified manner in part, of an exemplary embodiment of the directional control valve according to the invention.

DETAILED DESCRIPTION OF THE PREFERRED EMBODIMENT

A fitted directional control valve denoted as a whole by 1 in the FIGURE has a valve housing 3 in which a control piston 5 can be displaced in the axial direction, with reference to the longitudinal axis 7 of the housing, in order to bring about, in a 3/2-way function, a continuous control of a pressure-oil volume flow from the pressure-oil connection P to the consumer connection A and from the connection A to the tank connection T. The control piston 5 has a control collar 4 which is enlarged in diameter and partitions off two pressure chambers 6 and 8 in the housing 3. For actuation of the directional control valve 1, these pressure chambers 6 and 8 are connected via control connections 11 and 13, respectively, to a pilot valve 9 which, in turn, can be actuated by means of a control electronics unit 15 which is formed in a conventional manner and is therefore not illustrated and described in detail. The control electronics unit 15 is accommodated in the housing of an inductive travel sensor 17 which is attached to the valve housing 3 and via the control electronics unit 15 forms part of a positioning control circuit determining the axial position of the control piston 5.

That section of the control piston 5 which extends forward from the control collar 4, i.e. out of the valve housing 3, forms a pipe valve 10 which is guided in a valve bushing 12. The open, front end of said pipe valve forms the consumer connection A, while the pressure-oil connection P and tank connection T are offset inward. At an appropriate, axial position of the control piston 5, the first control aperture 16 and second control aperture 18 produce the connection to the pressure-oil connection P and to the tank connection T, respectively.

At its rear, inner end, the control piston 5 has equalizing channels 21 which form a connection to the inner pressure-equalizing chamber 23 in the valve housing 3. At the rear end, the control piston 5 is connected to a coaxial directional transmitter rod 25 which extends into a travel sensor tube 27 of the inductive travel sensor 17. A compression spring 29 is clamped between the rear end of the control piston 5 and the opposite wall of the pressure-equalizing chamber 23, said compression spring prestressing the control piston 5 for movement forward, i.e. out of the valve housing 3 (to the right in the drawing). If there is no activation, i.e. in an operating state in which there is no control pressure which is crucial for the position of the control piston 5, i.e. there is no difference in pressure between the pressure chambers 6 and 8, the actuating force of the compression spring 29 causes axial displacement of the control piston 5 into a position in which the control edges of the control apertures 18 form a connection from the interior of the pipe valve 10 to the tank connection T.

A resultant pressure-medium flow, which flows via the consumer connection A into the pipe valve 10 from the front end, exerts, depending on the strength of the pressure-medium flow, corresponding flow forces on the control piston 5, said forces counteracting the spring force of the compression spring 29 whose spring force is selected in such a manner that even pressure-medium flows of average strength are sufficient to prevent the compression spring 29 from greatly opening the connection from connection A to connection T. A cessation of the control pressure therefore leads only to a gradual reduction in pressure by a corresponding pressure-medium flow from connection A to connection T.

Instead of a spring arrangement as is realized in the exemplary embodiment by the compression spring 29, another type of actuator acting on the control piston 5 could be provided, for example an arrangement acting mechanically or electromagnetically via the directional transmitter rod 25. While the exemplary embodiment which is illustrated concerns a three-way directional control valve, it goes without-saying that it may also be advantageous in other types of valve, for example 2-way directional control valves, to ensure, when there is no activation, a defined operating state by means of an actuating force acting independently of the control pressure.

What is claimed is:

1. A directional control valve comprising;

of the actuating force is selected to be just sufficient so that the flow forces compensate for action of the actuating force on the control piston (5).

2. The directional control valve as claimed in claim 1, wherein the control piston (5) forms, at a front end of said control piston (5), a pipe valve (10) which is guided in a valve bushing (12) provided at a relevant end of a valve housing (3), wherein an open, front end of the pipe valve (10) is connected to the consumer connection (A), and wherein the pipe valve (10) has at least one control aperture (18) which produces the connection to the tank connection (T) in an axial position which is slid forward out of the valve housing (3).

3. The directional control valve as claimed in claim 2, wherein the prestressing force means comprises a spring (29) for producing the actuating force.

4. The directional control valve as claimed in claim 3, wherein the spring is a compression spring (29), said compression spring being supported at one end on a rear end of the control piston (5) and another end on an inner end of an interior of the valve housing (3).

5. The directional control valve as claimed in claim 1, wherein the prestressing force means comprises a spring for producing the actuating force.

6. The directional control valve as claimed in claim 5, wherein the spring is a compression spring (29), said compression spring being supported at one end on a rear end of the control piston (5) and at another end on an inner end of an interior of the valve housing (3).

7. A directional control valve comprising:

a valve housing with two pressure control chambers, a movable control piston disposed within the valve housing and having a control collar which separates the two pressure chambers from each other, which pressure chambers are subjectable to a control pressure to move the control piston along an axis of the valve housing into axial positions corresponding to respective ones of a plurality of switch positions of the valve in accordance with a difference in pressure prevailing between the two pressure chambers;

a system for applying an actuating force based on a difference in pressure between the two chambers upon the control piston, and for applying a prestressing force upon the control piston for movement into one of said axial positions wherein, in an absence of a difference in pressure between the two pressure chambers, said prestressing force positions the control piston for coupling fluid via an aperture of the valve housing in one of said switch positions, the coupling of fluid in said one switch position introducing an axially directed fluid force counteracting said prestressing force;

wherein said force applying system exerts an actuating force on the control piston that counteracts forces of the fluid which act on the piston during a flow of pressure medium from a consumer connection of the valve housing to a tank connection of the valve housing, and wherein an amount of the actuating force is selected to be just sufficient so that the flow forces compensate for action of the actuating force on the control piston.(5).

8. A valve according to claim 7, wherein said system for applying the actuating force includes a spring located between said piston and said housing for providing said prestressing force.

* * * * *

UNITED STATES PATENT AND TRADEMARK OFFICE

CERTIFICATE OF CORRECTION

PATENT NO. : 6,598,622 B1
DATED : July 29, 2003
INVENTOR(S) : Werner Reith et al.

It is certified that error appears in the above-identified patent and that said Letters Patent is hereby corrected as shown below:

Column 3,
Line 60, after the words "A directional control valve comprising:" insert the following paragraphs:

--a valve housing defining two pressure chambers (6 and 8), and a movable control piston (5) disposed within the valve housing and having a control collar (4) which separates the two pressure chambers (6 and 8) from each other in the valve housing, which pressure chambers are subjectable to a control pressure to move the control piston (5) into axial positions corresponding to relevant switch positions of the valve (1) in accordance with a difference in pressure prevailing between the two pressure chambers (6, 8);

prestressing force means (29) disposed in the valve housing and acting on the control piston (5) to produce an actuating force which prestresses said control piston (5) for movement into one of said axial positions corresponding to a desired predetermined state of the valve;

wherein, in a predetermined position to be assumed by the control piston (5) within the valve housing in the absence of a pressure difference between the pressure chambers (6, 8), the valve (1) forms a fluidic connection between a consumer connection (A) and a tank connection (T) of the valve housing; and wherein the prestressing force means (29) exerts an actuating force on the control piston (5) that counteracts flow forces of the pressure medium which act on said control piston during flow of pressure medium from the consumer connection (A) to the tank connection (T), and wherein an amount--

Signed and Sealed this

Seventeenth Day of February, 2004

Jon W. Dudas

JON W. DUDAS
*Acting Director of the United States Patent and Trademark Office*